US007090571B1

(12) United States Patent
Wang

(10) Patent No.: US 7,090,571 B1
(45) Date of Patent: Aug. 15, 2006

(54) BELT SANDER

(76) Inventor: Tian-Wang Wang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 11/097,618

(22) Filed: Apr. 4, 2005

(51) Int. Cl.
*B24B 21/00* (2006.01)

(52) U.S. Cl. ..... 451/296; 451/297; 451/304; 451/310

(58) Field of Classification Search ..... 451/296, 451/297, 304, 310
See application file for complete search history.

(56) References Cited

U.S. PATENT DOCUMENTS 5,199,220 A * 4/1993 Steiner et al. ..... 451/65

6,468,140 B1 * 10/2002 Wang ..... 451/310

* cited by examiner

*Primary Examiner*—Joseph J. Hail, III
*Assistant Examiner*—Shantese McDonald
(74) *Attorney, Agent, or Firm*—Alan D. Kamrath; Nikolai & Mersereau, P.A.

(57) ABSTRACT

A belt sander includes a base, a sanding device, a worktable, a tipping drive device, and a swinging device. The swinging device includes a cylindrical roller, a central shaft, a toothed ring, a drive gear, a cam, and a fixing rod. The swinging device drives the sanding device to produce a slightly reciprocally swinging action during operation of the sanding device. Thus, the grinding path and area of the sand belt are increased largely by the reciprocally and successively swinging action of the swinging device and the sanding device, so that the sand belt can be used to grind the wooden material exactly and efficiently, thereby greatly enhancing the grinding and finishing effect of the belt sander.

12 Claims, 4 Drawing Sheets

BELT SANDER

BACKGROUND OF THE INVENTION

1. Field of the Invention

The present invention relates to a belt sander, and more particularly to a belt sander having a reciprocally swinging effect.

2. Description of the Related Art

A belt sander is used to grind and finish a wooden material. However, the sand belt of the belt sander has a surface formed with particles arranged in an irregular manner, so that the surface of the wooden material is easily scratched by the sand belt, thereby decreasing the finishing effect of the belt sander. In addition, the sand belt of the belt sander has a rough surface, so that the wooden chips produced during the grinding process are easily attached to the surface of the sand belt. Thus, the worker has to clear the surface of the sand belt frequently, thereby decreasing the working efficiency of the belt sander.

A conventional belt sander in accordance with the prior art was disclosed in his U.S. Pat. No. 6,283,841-B1.

SUMMARY OF THE INVENTION

In accordance with the present invention, there is provided a belt sander, comprising a base, a sanding device mounted on an upper portion of the base, a worktable mounted on a front portion of the sanding device, a tipping drive device mounted on a first side of the sanding device, and a swinging device mounted on a second side of the sanding device.

The swinging device includes a cylindrical roller rotatably mounted on the second side of the sanding device and rotated by the sanding device, a central shaft mounted in the roller to rotate therewith, a toothed ring mounted on a lower end of the central shaft to rotate therewith, a drive gear meshing with and rotated by the toothed ring, a cam mounted on and rotated by the drive gear, and a fixing rod mounted on the cam to rotate therewith and connected to the roller to swing the roller by rotation of the cam to produce a reciprocally swinging action by a restoring spring.

The primary objective of the present invention is to provide a belt sander having a slightly reciprocally swinging action.

Another objective of the present invention is to provide a belt sander, wherein the swinging device drives the sanding device to produce a slightly reciprocally swinging action during operation of the sanding device.

A further objective of the present invention is to provide a belt sander, wherein the grinding path and area of the sand belt are increased largely by the reciprocally and successively swinging action of the swinging device and the sanding device, so that the sand belt can be used to grind the wooden material exactly and efficiently, thereby greatly enhancing the grinding and finishing effect of the belt sander.

A further objective of the present invention is to provide a belt sander, wherein the sand belt can be used to grind the wooden material smoothly, thereby preventing the wooden material from being scratched or worn by the sand belt so as to enhance the quality of the wooden material.

A further objective of the present invention is to provide a belt sander, wherein the wooden chips produced during the grinding process are not easily attached to the surface of the sand belt by the reciprocally and successively swinging action of the swinging device and the sanding device, so that the wooden chips can be cleaned easily and conveniently, thereby enhancing the working efficiency of the belt sander.

Further benefits and advantages of the present invention will become apparent after a careful reading of the detailed description with appropriate reference to the accompanying drawings.

DETAILED DESCRIPTION OF THE INVENTION

Figure 1:
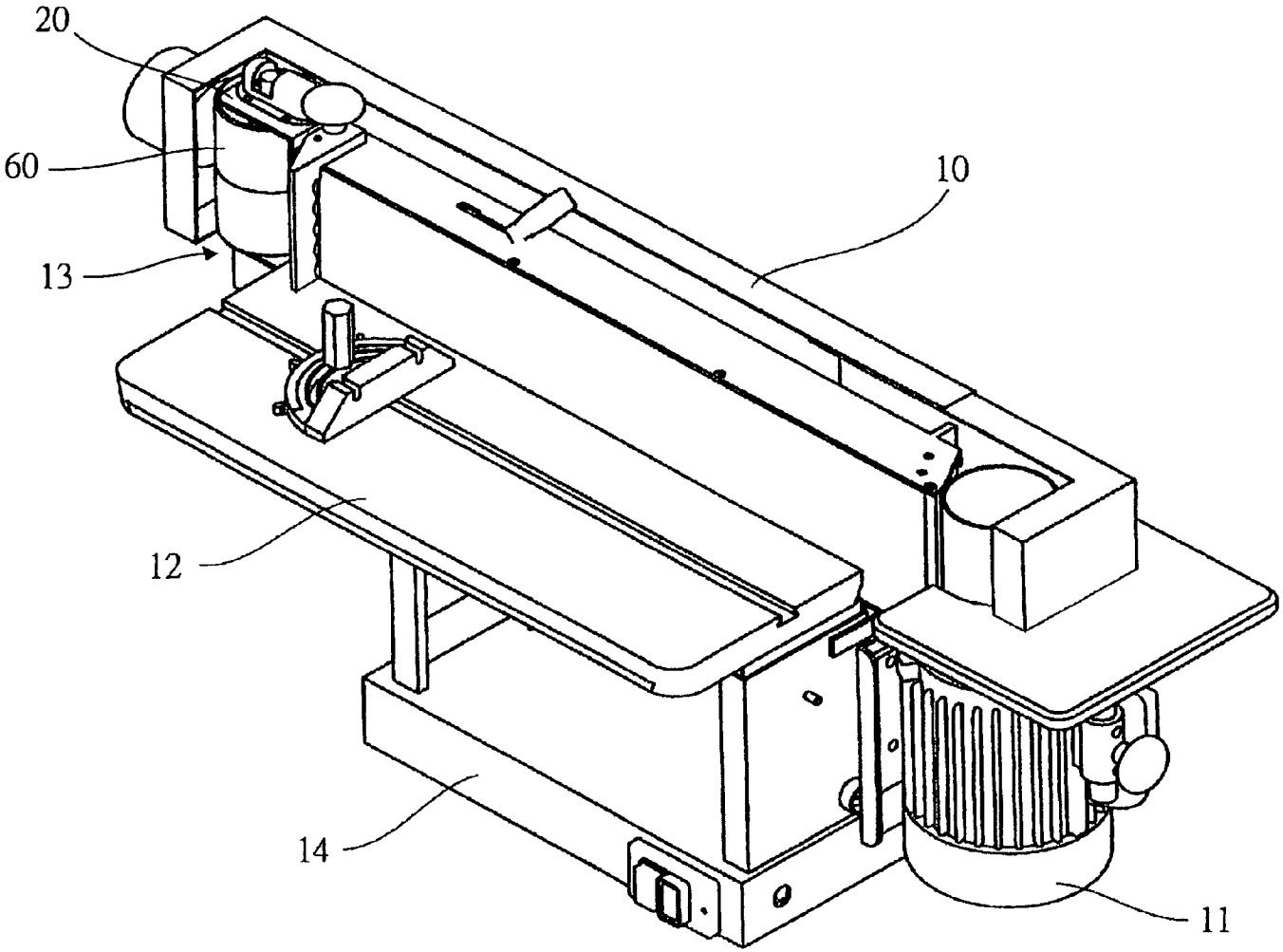
FIG. 1 is a perspective view of a belt sander in accordance with the preferred embodiment of the present invention.
Figure 2:
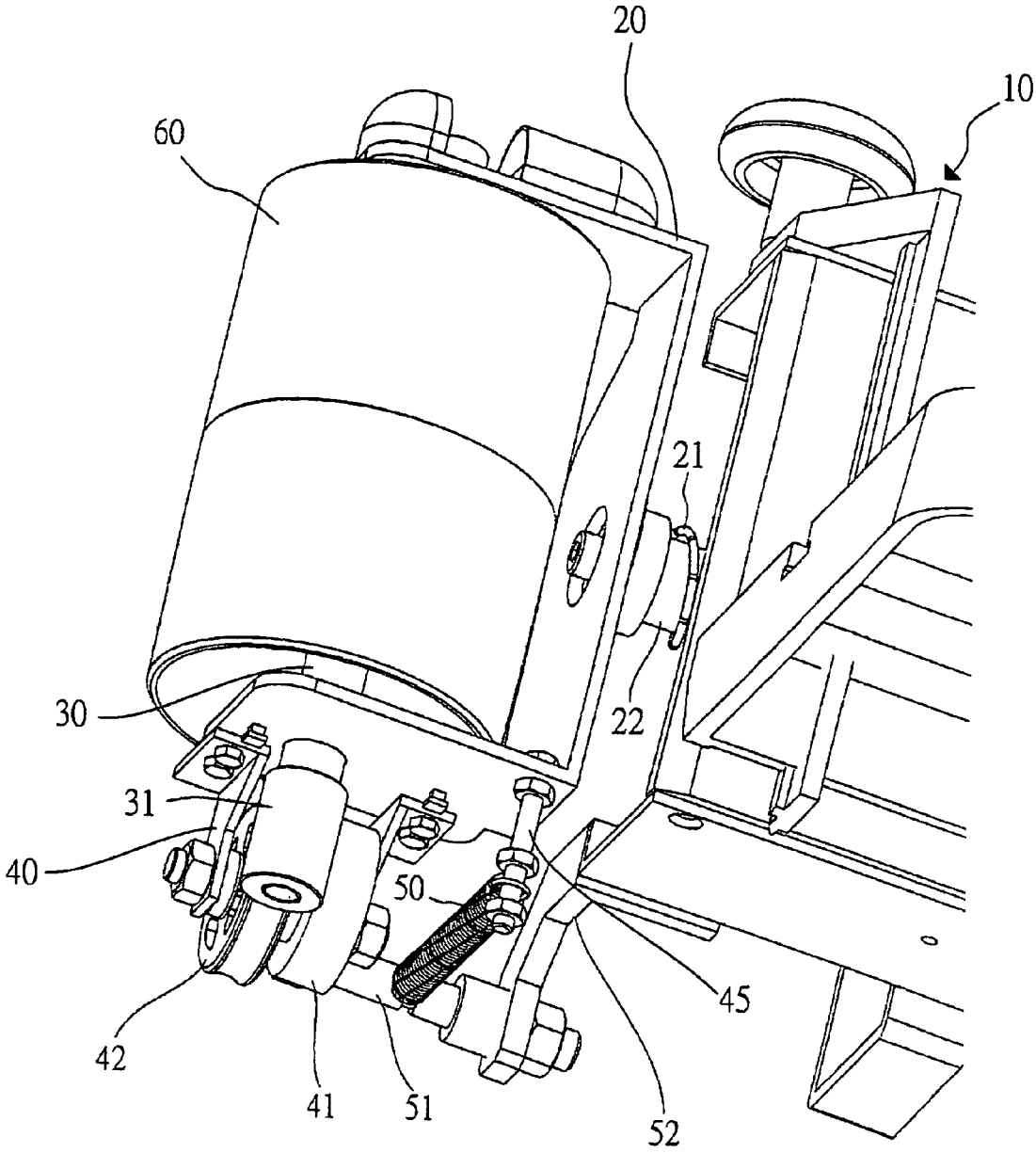
FIG. 2 is a partially perspective enlarged view of the belt sander as shown in FIG. 1.
Figure 3:
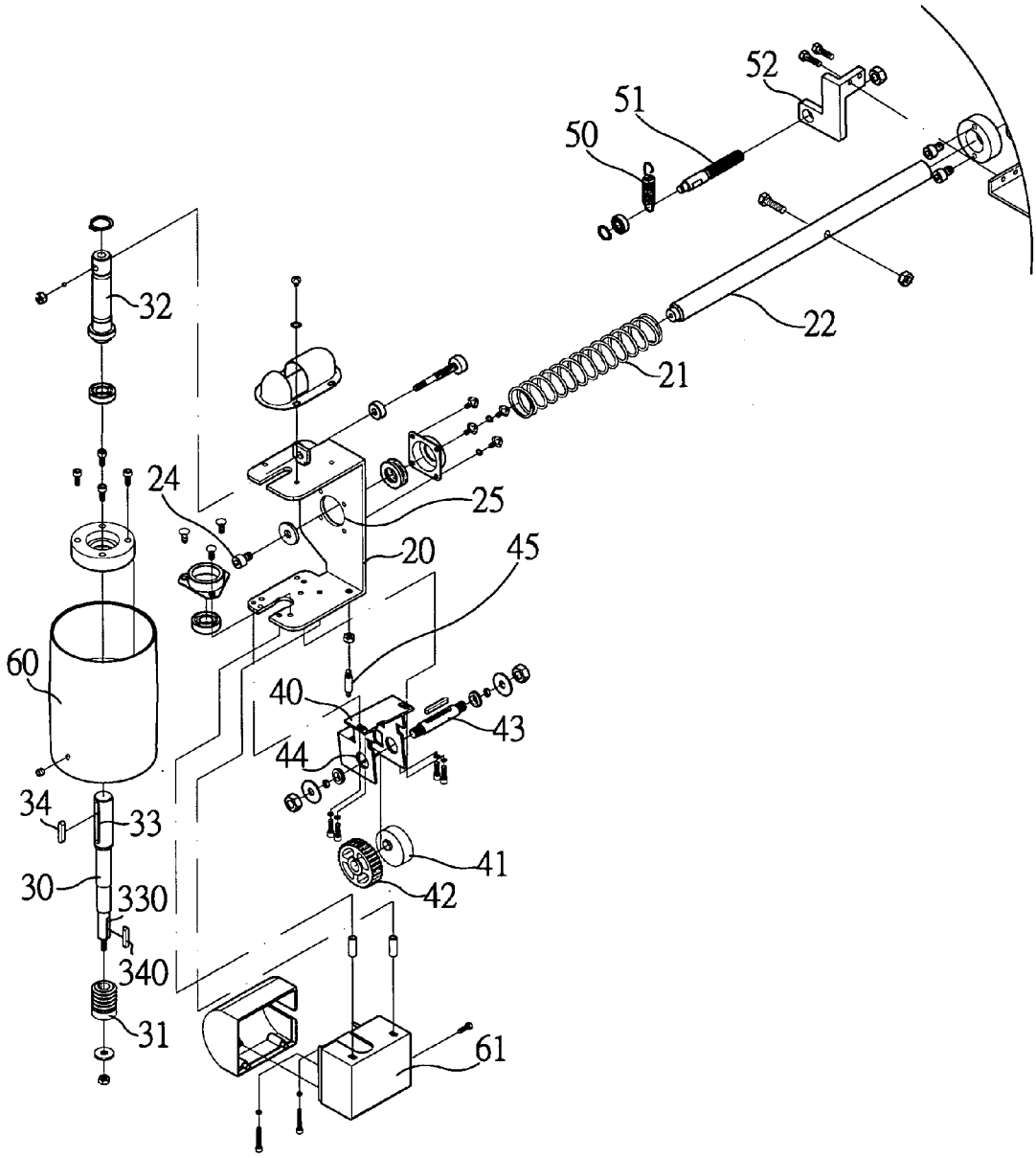
FIG. 3 is an exploded perspective view of the belt sander as shown in FIG. 2.
Figure 5:
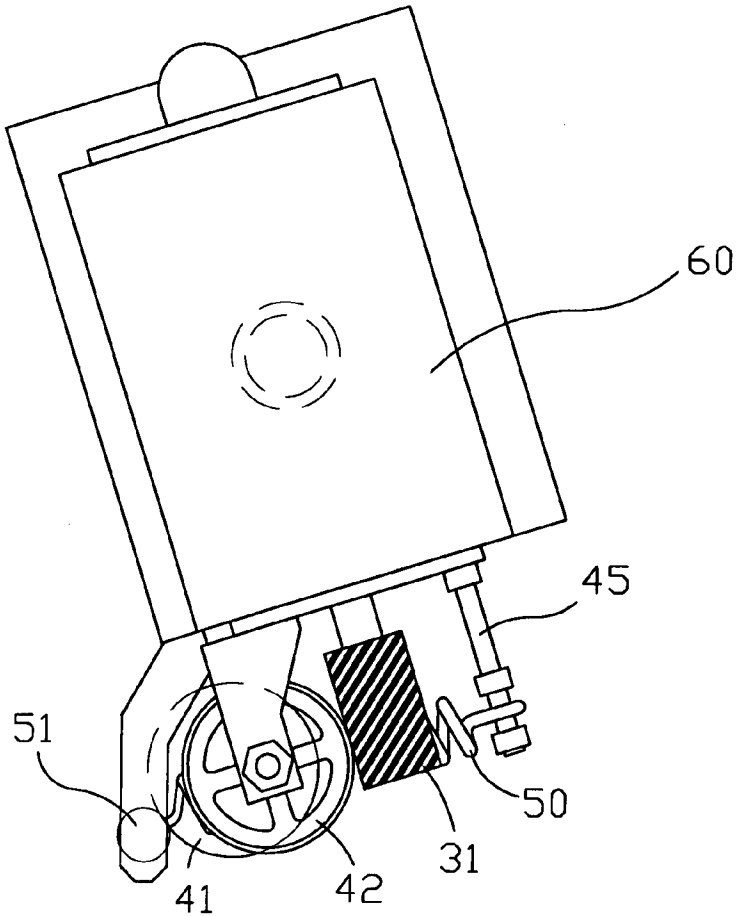
FIG. 5 is a schematic operational view of the belt sander as shown in FIG. 4.
Figure 4:
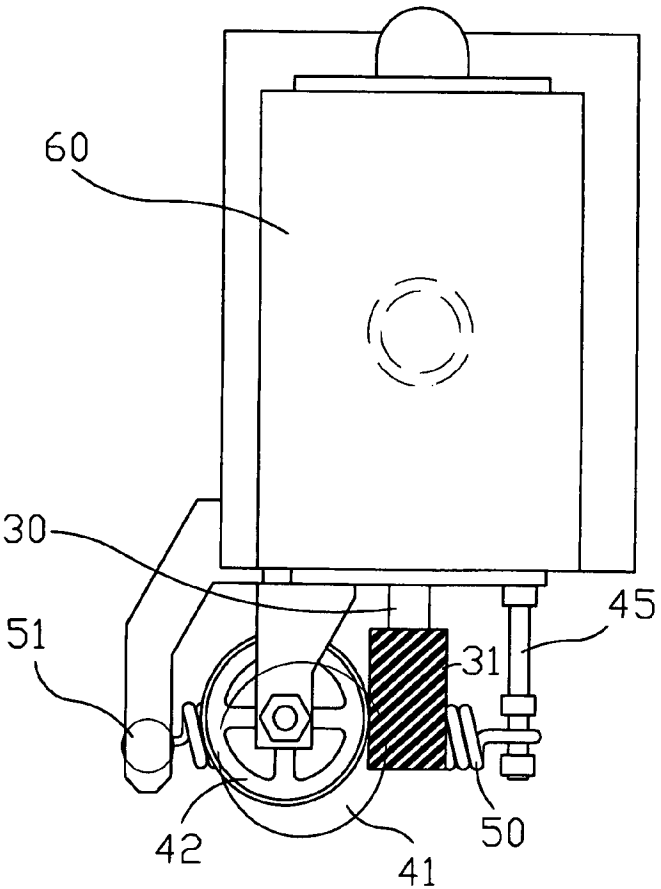
FIG. 4 is a plan view of the belt sander as shown in FIG. 2.

Referring to the drawings and initially to FIGS. 1–3, a belt sander in accordance with the preferred embodiment of the present invention comprises a base 14, a sanding device 10 mounted on an upper portion of the base 14, a worktable 12 mounted on a front portion of the sanding device 10, a tipping drive device 11 mounted on a first side of the sanding device 10 to adjust the angle of the sanding device 10 so as to satisfy different working requirements, and a swinging device 13 mounted on a second side of the sanding device 10.

The swinging device 13 includes a cylindrical roller 60 rotatably mounted on the second side of the sanding device 10 and rotated by the sanding device 10, a central shaft 30 mounted in the roller 60 to rotate therewith, a toothed ring 31 mounted on a lower end of the central shaft 30 to rotate therewith, a drive gear 42 meshing with and rotated by the toothed ring 31, a cam 41 mounted on and rotated by the drive gear 42, a fixing rod 51 mounted on the cam 41 to rotate therewith and connected to the roller 60 to swing the roller 60 by rotation of the cam 41 to produce a reciprocally swinging action by a restoring spring 50.

Thus, when the sanding device 10 is operated, the sand belt of the sanding device 10 is driven to rotate the roller 60 which rotates the central shaft 30 which rotates the toothed ring 31 which rotates the drive gear 42 which rotates the cam 41 which moves the fixing rod 51 which drives the roller 60 to swing by rotation of the cam 41 so as to produce a reciprocally swinging action by the restoring spring 50 so that the swinging device 13 has a reciprocally swinging effect.

The sanding device 10 has a bottom provided with a locking plate 52 for mounting the fixing rod 51.

The swinging device 13 further includes a substantially U-shaped first support bracket 20 for mounting the roller 60, and a substantially U-shaped second support bracket 40 mounted on the first support bracket 20.

The first support bracket 20 is mounted on the second side of the sanding device 10 to provide a support to the swinging device 13. The first support bracket 20 has a side formed with a circular hole 25 attached to the second side of the sanding device 10 by a transverse rod 22, a spring 21 and a locking nut 24.

The swinging device 13 further includes a drawing rod 45 having a first end locked on the first support bracket 20 for drawing the first support bracket 20 to swing the roller 60, and the restoring spring 50 has a first end mounted on a second end of the drawing rod 45 and a second end transversely mounted on the fixing rod 51.

The central shaft 30 is mounted in the first support bracket 20 and has a first end for mounting a connecting shaft 32 and a second end for mounting the toothed ring 31 which protrudes outward from the first support bracket 20. The first end of the central shaft 30 is formed with a first groove 33 to receive a first locking tenon 34 for locking the connecting shaft 32, and the second end of the central shaft 30 is formed with a second groove 330 to receive a second locking tenon 340 for locking the toothed ring 31.

The drive gear 42 and the cam 41 are mounted in the second support bracket 40 by a support shaft 43, and the second support bracket 40 has two sides each formed with a through hole 44 for mounting the support shaft 43. A housing 61 is mounted on the second support bracket 40 to cover the second support bracket 40.

In operation, referring to FIGS. 1–5, when the sanding device 10 is operated, the sand belt of the sanding device 10 is driven to rotate the roller 60 which rotates the central shaft 30 which rotates the toothed ring 31 which rotates the drive gear 42 which rotates the cam 41 so that the fixing rod 51 mounted on the locking plate 52 of the sanding device 10 is moved by rotation of the cam 41. At this time, the drawing rod 45 has a first end locked on the first support bracket 20 for drawing the first support bracket 20 to swing the roller 60, and the restoring spring 50 has a first end mounted on the second end of the drawing rod 45 and a second end transversely mounted on the fixing rod 51. Thus, when the cam 41 is rotated, the first support bracket 20 produces a reciprocally swinging action, so that the swinging device 13 and the sanding device 10 are driven to swing. At this time, the sand belt of the sanding device 10 is driven successively, so that the swinging device 13 and the sanding device 10 can produce a reciprocally swinging action successively during operation of the sanding device 10. Thus, the grinding path and area of the sand belt are increased largely by the reciprocally and successively swinging action of the swinging device 13 and the sanding device 10, so that the sand belt can be used to grind the wooden material exactly and efficiently, thereby greatly enhancing the grinding and finishing effect of the belt sander.

Accordingly, the swinging device 13 drives the sanding device 10 to produce a slightly reciprocally swinging action during operation of the sanding device 10. In addition, the grinding path and area of the sand belt are increased largely by the reciprocally and successively swinging action of the swinging device 13 and the sanding device 10, so that the sand belt can be used to grind the wooden material exactly and efficiently, thereby greatly enhancing the grinding and finishing effect of the belt sander. Further, the sand belt can be used to grind the wooden material smoothly, thereby preventing the wooden material from being scratched or worn by the sand belt so as to enhance the quality of the wooden material. Further, the wooden chips produced during the grinding process are not easily attached to the surface of the sand belt by the reciprocally and successively swinging action of the swinging device 13 and the sanding device 10, so that the wooden chips can be cleaned easily and conveniently, thereby enhancing the working efficiency of the belt sander.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A belt sander, comprising:

a base;

a sanding device mounted on an upper portion of the base;

a worktable mounted on a front portion of the sanding device;

a tipping drive device mounted on a first side of the sanding device;

a swinging device mounted on a second side of the sanding device; wherein the swinging device includes:

a cylindrical roller rotatably mounted on the second side of the sanding device and rotated by the sanding device;

a central shaft mounted in the roller to rotate therewith;

a toothed ring mounted on a lower end of the central shaft to rotate therewith;

a drive gear meshing with and rotated by the toothed ring;

a cam mounted on and rotated by the drive gear;

a fixing rod mounted on the cam to rotate therewith and connected to the roller to swing the roller by rotation of the cam to produce a reciprocally swinging action by a restoring spring; wherein the swinging device further includes a substantially U-shaped first support bracket for mounting the roller, and a substantially U-shaped second support bracket mounted on the first support bracket;

the swinging device further includes a drawing rod having a first end locked on the first support bracket for drawing the first support bracket to swing the roller; and the restoring spring has a first end mounted on a second end of the drawing rod and a second end transversely mounted on the fixing rod.

2. The belt sander in accordance with claim 1, wherein when the sanding device is operated, the sand belt of the sanding device is driven to rotate the roller which rotates the central shaft which rotates the toothed ring which rotates the drive gear which rotates the cam which moves the fixing rod which drives the roller to swing by rotation of the cam so as to produce a reciprocally swinging action by the restoring spring so that the swinging device has a reciprocally swinging effect.

3. The belt sander in accordance with claim 1, wherein the sanding device has a bottom provided with a locking plate for mounting the fixing rod.

4. The belt sander in accordance with claim 1, wherein the first support bracket is mounted on the second side of the sanding device to provide a support to the swinging device.

5. The belt sander in accordance with claim 1, wherein the first support bracket has a side formed with a circular hole attached to the second side of the sanding device by a transverse rod, a spring and a locking nut.

6. The belt sander in accordance with claim 1, wherein the central shaft is mounted in the first support bracket and has a first end for mounting a connecting shaft and a second end for mounting the toothed ring which protrudes outward from the first support bracket.

7. The belt sander in accordance with claim 6, wherein the first end of the central shaft is formed with a first groove to receive a first locking tenon for locking the connecting shaft, and the second end of the central shaft is formed with a second groove to receive a second locking tenon for locking the toothed ring.

8. The belt sander in accordance with claim 1, wherein the drive gear and the cam are mounted in the second support bracket by a support shaft.

9. The belt sander in accordance with claim 8, wherein the second support bracket has two sides each formed with a through hole for mounting the support shaft.

10. The belt sander in accordance with claim 1, wherein the swinging device further includes a housing mounted on the second support bracket to cover the second support bracket.

11. The belt sander in accordance with claim 1, wherein the swinging device drives the sanding device to produce a reciprocally swinging action during operation of the sanding device.

12. The belt sander in accordance with claim 1, wherein the swinging device and the sanding device produce a reciprocally swinging action successively during operation of the sanding device.

* * * * *